US010174515B1

(12) United States Patent
Krivens

(10) Patent No.: US 10,174,515 B1
(45) Date of Patent: Jan. 8, 2019

(54) SEMI-PRIVATE DESK AND MEETING AREA

(71) Applicant: Daniel John Krivens, San Francisco, CA (US)

(72) Inventor: Daniel John Krivens, San Francisco, CA (US)

( * ) Notice: Subject to any disclaimer, the term of this patent is extended or adjusted under 35 U.S.C. 154(b) by 0 days.

(21) Appl. No.: 15/588,546

(22) Filed: May 5, 2017

Related U.S. Application Data

(60) Provisional application No. 62/333,104, filed on May 6, 2016.

(51) Int. Cl.

| | |
|---|---|
| ***E04H 1/12*** | (2006.01) |
| ***A47B 87/00*** | (2006.01) |
| *E04H 1/00* | (2006.01) |
| *A47F 10/00* | (2006.01) |

(52) U.S. Cl.
CPC ..... *E04H 1/12* (2013.01); *A47B 87/00* (2013.01); *A47B 2200/0071* (2013.01); *A47F 10/00* (2013.01); *E04H 1/00* (2013.01)

(58) Field of Classification Search
CPC .. E04H 1/12; E04H 1/00; A47B 87/00; A47B 10/00; A47B 2200/0071
See application file for complete search history.

(56) References Cited

U.S. PATENT DOCUMENTS

| | | | | |
|---|---|---|---|---|
| 1,406,021 | A * | 2/1922 | Ihmels | B60P 3/0257 296/21 |
| 3,450,190 | A * | 6/1969 | Mittermaier | B22D 18/04 164/309 |
| 3,498,011 | A * | 3/1970 | Lindgren | E04H 1/125 109/73 |
| 3,694,974 | A * | 10/1972 | Eckel | E04B 1/8218 181/198 |
| 4,914,873 | A | 4/1990 | Newhouse | |
| 5,083,512 | A | 1/1992 | Newhouse et al. | |
| 5,282,341 | A * | 2/1994 | Baloga | A47B 83/001 49/41 |
| 5,687,654 | A * | 11/1997 | Huggins | A47B 5/00 108/106 |
| 5,787,648 | A * | 8/1998 | O'Malley | A47B 83/001 108/50.01 |
| 5,842,758 | A * | 12/1998 | Kelley | A47B 21/00 312/196 |
| 6,102,475 | A | 8/2000 | Hamann | |
| 6,474,025 | B1 | 11/2002 | Faiks et al. | |
| 6,536,356 | B2 | 3/2003 | Krieger et al. | |
| 6,615,550 | B2 | 9/2003 | Reuschel et al. | |
| 6,701,682 | B2 * | 3/2004 | Ando | G06Q 10/10 52/234 |
| 7,249,741 | B1 | 7/2007 | Larson | |
| 7,438,002 | B2 | 10/2008 | Murray | |
| 2006/0283358 | A1 | 12/2006 | Mueller et al. | |
| 2009/0047653 | A1 | 2/2009 | Turner | |

FOREIGN PATENT DOCUMENTS

| | | | | |
|---|---|---|---|---|
| DE | 2125043 | A1 * | 1/1972 | E04B 1/34815 |
| WO | WO-0119216 | A2 * | 3/2001 | A47B 83/001 |
| WO | WO-2017181133 | A1 * | 10/2017 | E04B 1/343 |

* cited by examiner

*Primary Examiner* — Jeanette E Chapman
(74) *Attorney, Agent, or Firm* — Thomas M. Freiburger

(57) ABSTRACT

A combination of a covered, raised corner desk and seating area and walk-up corner bar provides a degree of security and privacy while encouraging working together and meeting with persons standing at the outside of the bar/desk.

17 Claims, 15 Drawing Sheets

SEMI-PRIVATE DESK AND MEETING AREA

This application claims benefit from provisional application Ser. No. 62/333,104, filed May 6, 2016.

BACKGROUND OF THE INVENTION

This invention concerns desks and seating areas for hospitality, education, study, outdoor use, and for business or residential use. In particular the invention relates to a compact structure providing a raised corner seating area for one or two with a desk of a specialized shape for the seated person(s), also providing a convenient bar or table for meeting with persons standing at the desk/bar outside the structure. The structure or pod can stand alone or be arranged in tandem with other pods.

Feeling safe when collaborating is the foundation of successful interactions, and increasing chance encounters is a proven way to increase idea exchange within a group. Providing physical places for this to occur has a paradox: creating a productive place in which to sit down to achieve privacy, refuge, or a sense of safety comes at the cost of erecting barriers to interaction. Any level of enclosure typically restricts entry to others sending out a message that one does not want to interact. It is also more difficult for chance interaction to occur because persons' eyes are not in the same height range. The desired effect of feeling secure is also partially negated by reducing one's height lower relative to passersby, thus unintentionally subordinating oneself. Sitting down and blocked off is the antithesis of establishing an environment to feel secure and encourage serendipitous interactions.

In an effort to provide areas that are more private and provide a sense of shelter, people create separate rooms with doors that create a strong barrier to interaction. Even less enclosed, semi private options often mostly enclose people where they can sit with eye level at around +48", making it more difficult for someone walking by to interact. Even semi-private raised enclosures that get people's seated eyesight at roughly +60" (around the eye level of people passing by) still block interactions because the booths or enclosures are very inward focused with no interface for guests to walk up and spontaneously join in without having to commit and take a seat. The need for persons walking by to take a chair also subtly implies a substantial time commitment to any meeting.

The primal need for a sense of personal physical and psychological security can be at odds with our other need to engage in social activities. The same barriers that protect, essentially repel. Whether in the context of work, study, reading, relaxation or other situations, people often prefer the psychological safety of a private space where interaction is limited and highly controlled, but it has a price: it limits interaction. Research shows that the best and fastest solutions to issues come from harnessing the group's intelligence via lots of spontaneous casual interactions. People still need to feel safe, but there has to be a high level of engagement. The most spontaneous interactions occur between people passing by each other, so any solution that seats people at regular chair height misses this goal.

The layers of isolating elements, and the additional time commitment chairs demand, act to discourage spontaneous interactions. This impedes upon the efficiency of individuals and groups of people working together. As a result, the group is less likely to harness the collective intelligence of the team to get the best answers to issues in the least amount of time.

SUMMARY OF THE INVENTION

With the current invention, a covered, raised booth gives the occupant or occupants a sense of refuge. The table of the structure does double duty as a stand-up corner bar which creates an interface between the refuge and the easy, impromptu social interactions that can happen at a walk-up bar. The invention simultaneously provides a sense of security and a platform for easy interaction.

The corner bar aspect of this refuge provides people sheltered within it the effortless opportunity to engage with passersby in spontaneous interactions.

This easy interaction between occupants who feel more secure and people passing by will increase the likelihood that unexpected serendipitous interactions will occur, helping the individuals and groups reach their fullest potential.

In one preferred form the invention is embodied in a semi-open booth type structure having an elevated floor/footrest and a table/desk/bar supported above the floor. Two seats, which can be chairs or stools, are positioned behind the table/desk, and the desk can have a generally square shape that will accommodate two persons, one on each seat generally at right angles to each other. Extending arms can be included on the desk, one arm to the side of each seated person. The structure has two wall uprights, the two walls being at approximately right angles and each being generally at one end of an extending arm (if included) of the desk, the walls preferably serving also as backrests for the seated persons. The two walls are separated such so as to provide a rear opening for ingress and egress of persons to be seated at the desk, the opening being wide enough for people sitting at the desk to comfortably exit the work station and for them to have sufficient distance when seated so that their knees and feet do not bump into each other. An elevating structure supports the unit above a surrounding floor, at a height approximately such that persons seated behind the desk will be at eye level (or within about 12 inches at eye level) with persons stopping by the workstation at the outer side of the desk. The seated and standing persons can thus be closer than would be the case if the seated person were not elevated. The under floor structure may be steel, for example, and can have wheels for moving the unit. Preferably a form of partial roof is included, supported at the tops of the two walls, to lend more feeling of enclosure, security or privacy and to improve acoustic quality.

The structure in one form occupies a space of about 5 feet 6 inches by 5 feet 6 inches (or within 3 to 6 inches each way).

In another embodiment of the invention, the semi-private enclosure is designed for a single person, with the option of being open at sides and/or front, or being fully closed. The shape of the table or desk is different, generally of an irregular pentagon shape but with the angled side curving concavely to comfortably accommodate a user seated on a bench or stool. In front of the user, outer ends of the desk form an exterior corner. Two sides of the unit at left and right of the desk corner are completely open, but one or both sides can be partially or completely closed as desired. The space below the desk preferably is closed at those two sides.

To the immediate left and right of the user are clear wall panels, one of which or both of which can open as a door. These panels/doors can range from opaque to transparent. A back wall behind the user, which is relatively narrow, serves also to support a backrest for the seated person. Ingress and egress are provided via the one or both door panels, to left and right of the back wall. Height of the floor, seat and table are essentially as described above for the earlier-described embodiment. A roof can be provided on the pod or enclosure, but is optional. Again, the unit or pod can optionally have wheels or glides to facilitate movement to different positions on a floor.

As in the other embodiment, standing persons passing by the enclosure can converse approximately at eye level with the seated person and can use a bar rail that is preferably provided.

When desired the person seated in the enclosure can close all doors and windows so as to be essentially sealed and isolated from exterior sounds and to indicate to others a desire for privacy. The unit can even be used outdoors, fully closed when needed and with a heater.

The structure occupies a space preferably about four feet six inches by four feet six inches, although the dimensions can be greater or smaller. Preferably the dimension areas are as stated or within three to six inches either way, occupying about 20 square feet.

The height of the unit can be important. For commercial interior use it is advantageous that the height be no greater than five feet nine inches so that the unit can be classified as furniture under regulatory restrictions including building codes. This height limitation works well for the pod unit because it has no interior standing floor area. The interior of the pod is all seat and table.

It is a primary object of the invention to promote interaction between one or two persons seated at a desk and persons at the outer side of the desk, while enabling partial (or full) enclosure of the seated persons to provide a feeling of security and semi-privacy. These and other objects, advantages and features of the invention will be apparent from the following description of a preferred embodiment, considered along with the accompanying drawings.

DESCRIPTION OF THE DRAWINGS

FIGS. 11A and 11B are schematic plan views showing three of the enclosure pods aggregated together, and four of the pods aggregated together, respectively.

DESCRIPTION OF PREFERRED EMBODIMENTS

Figure 1:
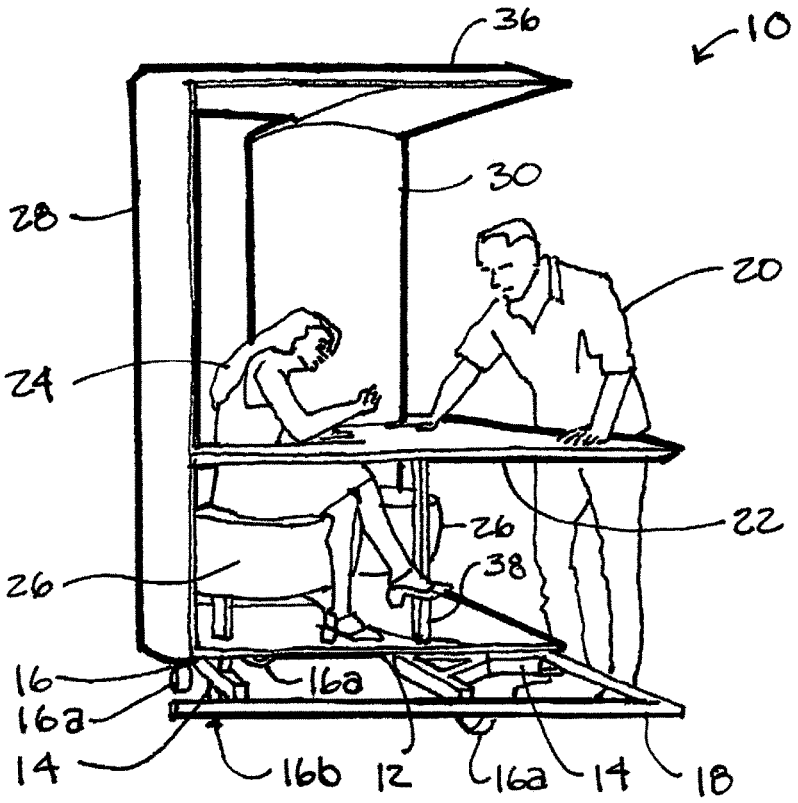
FIG. 1 is a perspective view showing a first embodiment of a semi-private desk or enclosure and meeting structure of the invention.

FIG. 1 shows a structure 10 that serves as a semi-private desk and meeting place for persons in an environment where personal refuge, study, or social interaction is to be promoted. The structure 10 includes a footrest or floor 12 elevated above the building floor (or outdoor ground) such as by support structure 14, 16 as illustrated. The elevated structure may include wheels 16*a* at several locations, such as in a triangular formation as shown, to enable portability of the workstation structure 10. Adjustable levelers or jacks can be included, as at 16*b*, to stabilize the structure at a particular location.

In a preferred embodiment a foot rail 18 is attached to the support structure or forms a part or extension of the support structure. This enables a standing person 20 at the outside of the desk to elevate one foot onto the bar rail for comfort. The desk 22 of the unit is thus at approximate bar height (e.g. 40" to 42" or somewhat higher if desired) to the person 20 standing outside. The support structure 16 elevates the floor 12 approximately 10" to 14" above the surrounding floor structure, so that a person 24 sitting at the desk within the unit 10 is generally at about the same eye level as an average person 20 standing outside of the bar. The desk 22 may be, for example, about 27" to 31", more preferably about 28" to 30" above the surface of the floor 12, i.e. in the range of standard desk height.

Figure 3:
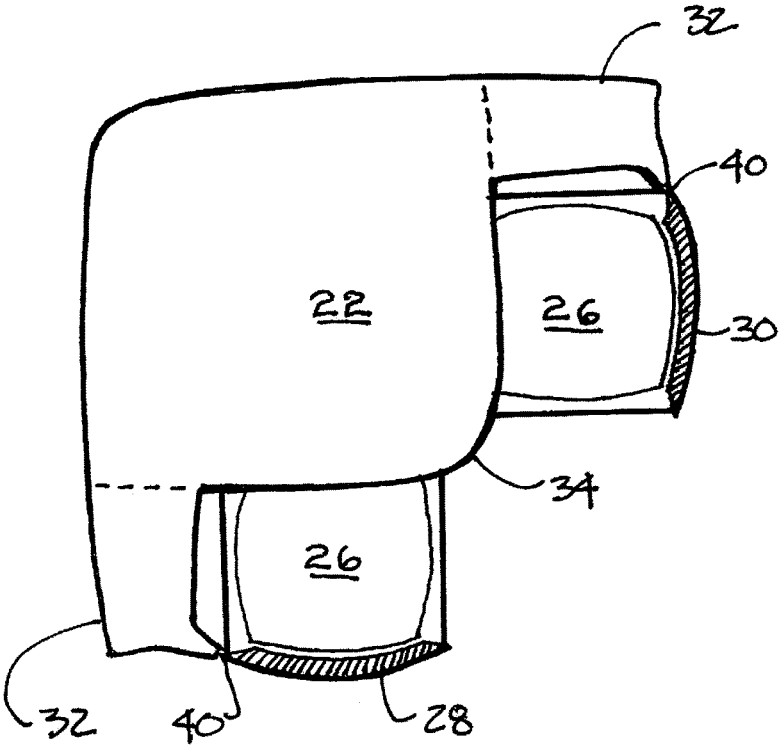
FIG. 3 is a plan view of the desk/enclosure, omitting the roof or top structure shown in the other drawings.
Figure 4:
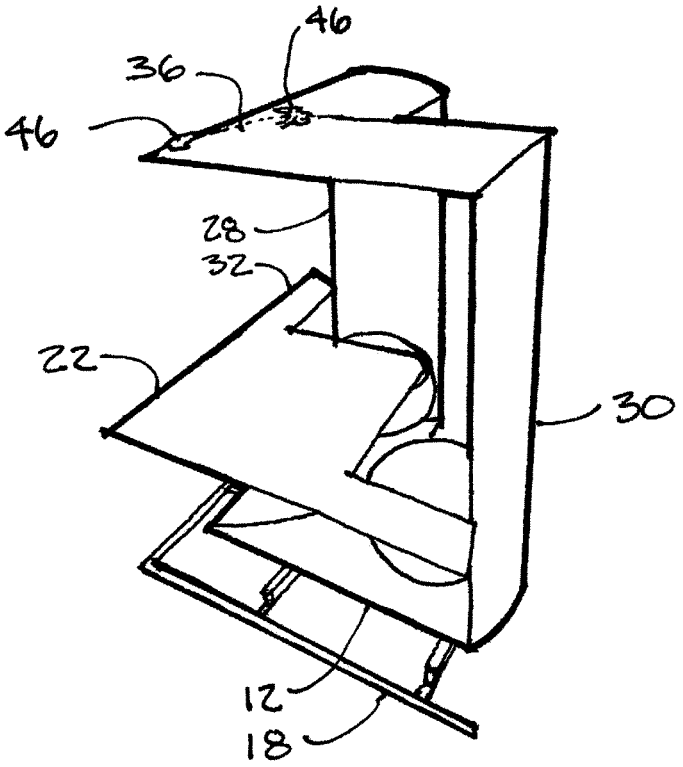
FIG. 4 is a perspective view showing the desk/enclosure but with an elevating understructure not shown.

As seen in the drawings, two seats 26, which preferably are padded or have cushions, are supported above the floor and spaced apart so that two persons can use the desk or table 22 together without knees and feet colliding. The plan view of FIG. 3 (a section view cut through two vertical partial enclosure walls 28 and 30 of the unit) shows the general shape of the table or desk 22. As shown, the table is very roughly square in shape but preferably with two arms 32 that are essentially perpendicular to one another and conforming to the outer shape of the table as illustrated (see particularly FIGS. 3 and 4). The main, essentially square section 34 of the desk establishes two distinct seating areas approximately at right angles to one another. Thus two people sit at a corner desk, which may have side arms.

Figure 2:
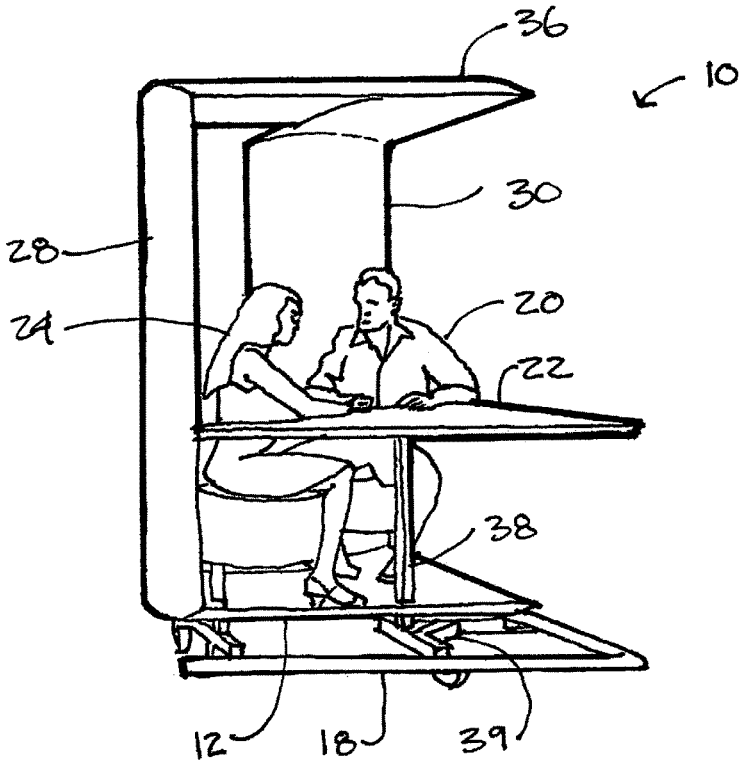
FIG. 2 is a semi-perspective view, showing two persons seated at the desk.

FIG. 2 shows two persons 20 and 24 seated at the desk 22 within the workstation structure 10. A partial roof or ceiling 36 overhead, along with the two walls 28 and 30 at two sides of the desk and floor, give a feeling of partial closure, security and semi-privacy, while also being open to someone outside the unit, who might be passing by and might wish to have a discussion with the person(s) seated within the unit. FIG. 2 also shows the desk 22 is preferably supported by a post 38 secured in a stable structural attachment to the floor 12 (or to structure below) and secured to the table 22 at its bottom side. The structure supporting the desk preferably includes a steel rail 39, a part of the understructure 14, to which the bottom end of the post 38 is rigidly secured, as by welding or bolts. Alternatively the post could simply be attached to the floor 12, via a plate or brackets. The desk preferably also is connected via the arms 32 to each of the upright walls 28, 30, as shown at 40 in FIG. 3. This can be a steel connector, for example, secured to the wall and desk, at an edge of each of the desk arms 32. These connections provide a stable support for the desk within the workstation enclosure 10. However, as indicated by dashed lines in FIG. 3, one or both of the arms or bar-side extensions 32 could be eliminated to provide access from that side, or one or both could be hinged to pivot over onto the desk if desired.

Figure 5:
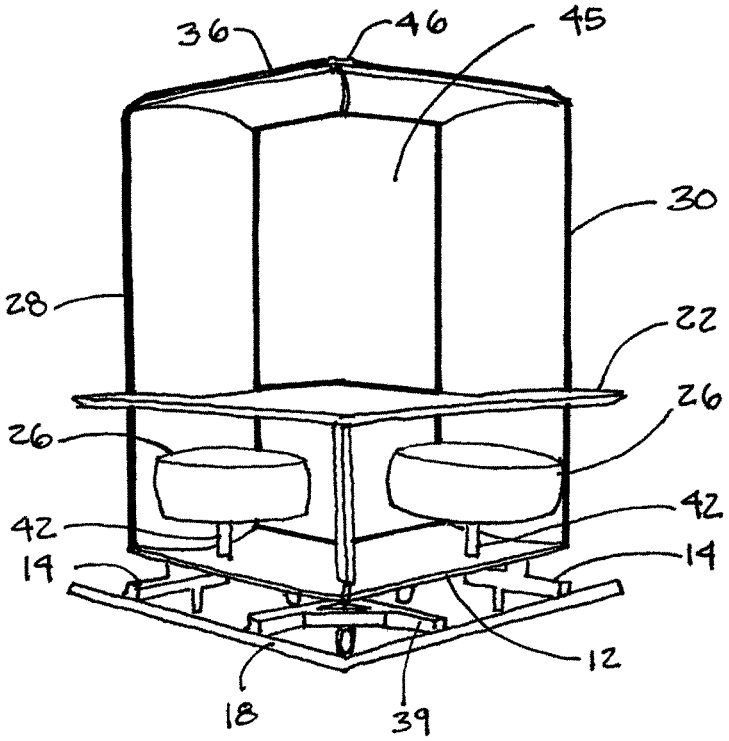
FIG. 5 is another perspective view from the front of the structure.
Figure 6:
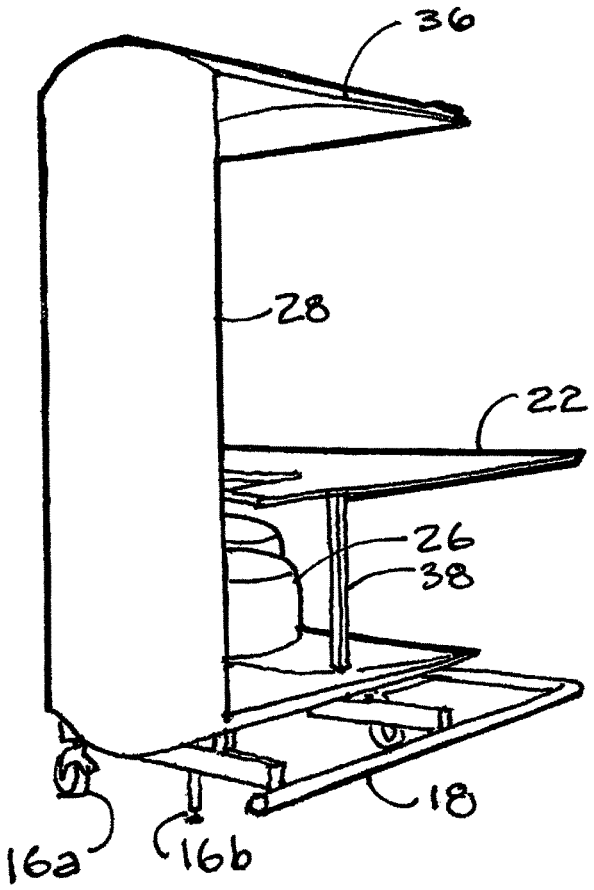
FIG. 6 is a perspective view showing the structure from right-rear.
Figure 7:
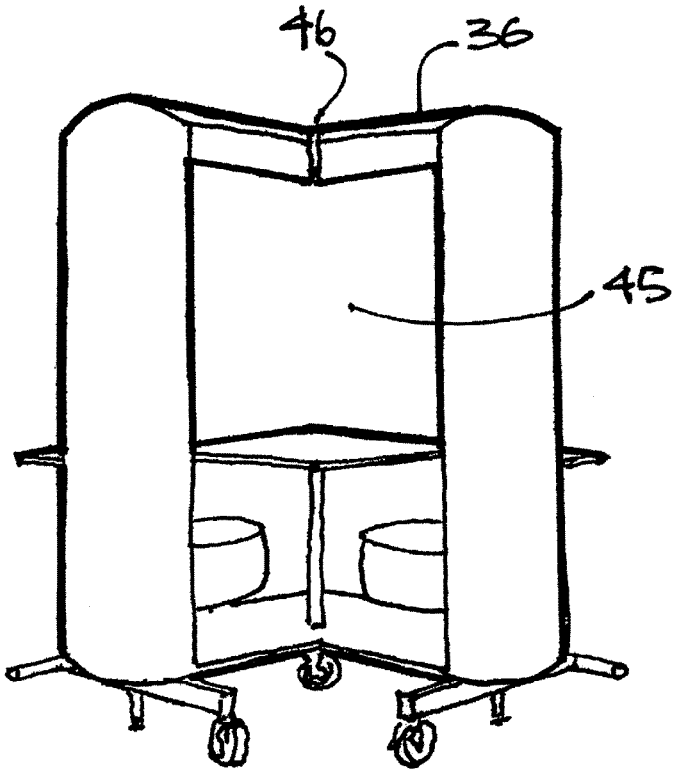
FIG. 7 is another perspective view, looking at the structure from the rear, at an ingress/egress opening.

FIGS. 1, 2 and 5 show that the chairs or stools 26 may be supported from the floor 12, by posts 42 that rise from structure associated with the floor 12, the stools 26 also being secured to the upright walls 28, 30 in a preferred embodiment. The stools could be separate and brought in by the user(s). Alternatively, the seats/stools could be supported by the walls 28, 30 such as with brackets. Connection can be by bolts, screws or other fasteners. As with the desk support, the seat posts 42 may be secured to components of the understructure 14 for added stability.

As seen in most of the drawings, the two upright walls 28 and 30 are separated so as to leave an opening 45 of several feet, preferably about three feet (or a range of about 2.5 to 3.5 feet), for ingress and egress of persons using the workstation. The opening 45 allows unhindered movement in or out by either occupant.

The drawings also show that both for aesthetic reasons and comfort, each wall 28, 30 preferably is curved. The curved shape of these walls, concave to the inside, provides a comfortable back rest for seated persons, while also tending to bounce sound back into users' ears making it easier to hear one another within the enclosure, thus lowering voice requirements and making use of the unit a quieter experience and allowing it to fit into spaces where one does not want a noisy environment. The curved nature also renders strength to the walls 28 and 30, which is important with the roof 36 being supported from the walls. The curvature allows for a stronger overall system rigidity with less material. This is especially true at corner joints. The roof or ceiling can be made of two pieces secured together, which can be by connectors 46 as shown, for example, in FIGS. 4 and 5. Other wood joining techniques can be used if desired. A roof is not essential for indoor use, but helps reinforce the sense of security and improves sound control within the workstation structure.

The drawings also show that roof or ceiling 36 may be arched, at least at the upper side and also preferably at the bottom side. This is seen in FIGS. 1, 4, 6 and 7. Thus, the upper edges of the upright walls 28 and 30 can be formed in an arch to conform to the shape of the roof.

As noted above, the roof 36 is preferred but optional. If included it extends over the table, mirroring the shape of the floor 12 below, and defining a rectangular space. The square part 34 of the table is about 3.5 feet on a side, or a range of about 2.5 feet to 3.8 feet.

As noted above, the table 22 preferably has bar-side arm extensions 32 that connect to the upright walls 28 and 30. One or both of these arms 32 can be eliminated if desired, so as to provide bar-side access into the seating area.

The enclosure with walls 28, 30 and roof 36, as well as the table/bar 22 itself, provides a maximum sense of protection that minimizes any sense of separation between the occupants and people passing by. The elevated seating also puts an occupant in superior elevation to regular chair height. Occupants get the sense that someone cannot sneak up on them or peak over their shoulder, yet they are given a heightened vantage point to be able to survey what is going on around them. The table 22 provides a comfortable place to conduct any activity, such as eat, play, socialize or work. The arm extensions 32 protect and enclose without being a barrier to interaction. These all combine to make a person feel more protected and safe, which frees up emotional and mental resources that can be spent on creativity, writing, etc., or socializing. The simple geometry of the two interior corner seats 26 at the table 22 provides an ideal interface for collaboration between two occupants in the unit. The corner bar aspect of the table 22 capitalizes on the occupants' feeling of safety and thus enhanced social capital by allowing them to interact spontaneously with passersby. Passersby can walk up to the barrier-free, socially inviting corner bar 22 and relax with a foot up on the foot rail 18 for immediate eye-to-eye communication with occupants unencumbered by having to ask for a chair or the awkwardness of hovering over a seated person lower than themselves. A corner bar facilitates easier communication between bar occupants than a straight bar because those at the bar can see each other more easily. This corner advantage is most fully realized in the invention because the walk-up people can not only see each other but also automatically face the occupants on the interior corner seating. The table 22 with bar extensions **22*a* provides conventionally required space for five or six people at the bar plus the two occupants at seats 26**, so everyone can enjoy the ease of communicating with someone close by without being overcrowded.

The extreme efficiency of the layout, including the fact that the entire interior is all seat and table, with no standing area, keeps the size of the unit 10 extremely compact, so that it can be moved easily on its wheels **16*a*** by just one or two people so that people can easily adjust the unit's position as needs arise.

The invention can be made of any materials durable enough for conventional furniture construction. Means and methods can vary. The critical issue is to achieve the required ergonomic standards for the culture the unit is built for. Assuming western society standards, the table 22 should be at a standard bar-height, preferably about 40-42 inches (or possibly somewhat higher) from the surrounding floor. When two people are seated at the interior corner seats 26 there should be enough clearance so that people's feet aren't likely to touch when resting on the foot platform or floor 12. There should be enough room for easy ingress and egress to the seats from access at back 45 (or optional access at sides). The roof should be high enough for head clearance when entering, and it should not extend out past the table by more than 4", to avoid causing a hazard to people walking past.

Primary features of this embodiment of the invention are (1) the unit has a table preferably 40"-42" high from outside, (2) with exterior corner bar; (3) an elevated floor or footrest 22, (4) with seats 26 at opposite corners of the enclosure; (5) the seats have back and head enclosure walls 28, 30; and (6) an ingress/egress opening located between the walls and between the interior elevated seating.

Instead of the wheels **16*a* beneath the unit, temporary carpeted dollies could be used, or the unit could have glide rails to slide on a carpeted floor. The jacks or levelers 16*b* help stabilize the unit in position, but shims could be substituted. Bar-side access to the interior of the unit, not illustrated, will allow for ingress/egress from the bar side, if the desk extensions are not included, or if they are hinged to fold over or otherwise retractable. The bar foot rail 18**, extending around the entire bar area, makes it more comfortable for passersby to rest a leg while speaking to someone at the desk, although the bar rail is not essential.

Two or three of the units 10 of the invention can be placed alongside each other, such as at 90° angles, with the exterior corner bar of each unit facing outward and the tables side by side. This will create efficiency by consolidating the ingress/egress area to serve the two or three units, at the rear of each unit. Moreover, multiple units 10 can be arranged in a variety of configurations to take advantage of sight opportunities, views, or to provide more meeting and multifunction areas.

Figure 8:
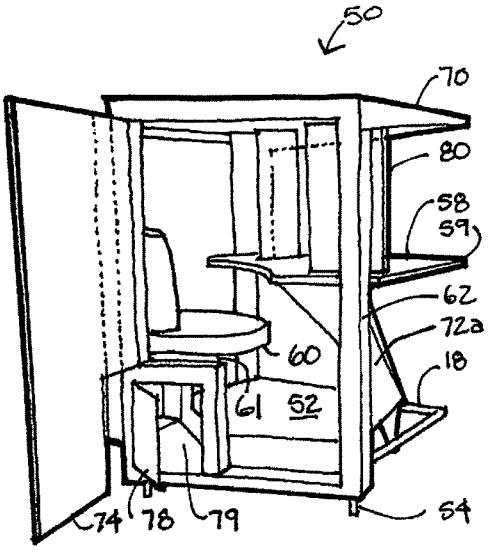
FIG. 8 is a perspective view demonstrating a second embodiment of a desk enclosure unit according to the invention, with a person seated in the unit and a person at the bar outside the unit.

FIG. 8 shows another form of the invention, a structure 50 that functions as an open or private desk area serving as a general purpose work, study and social interaction station. It can be a private desk or a meeting place for persons in an environment where personal refuge or social interaction is to be promoted. The unit or structure or pod 50 includes a footrest or floor 52 elevated above the building floor or outdoor ground by legs 54 as illustrated. This need not be a structural floor since no one will be standing up in the unit. The structure may include wheels (not shown) as in the first embodiment at several locations if desired for portability, or it could have glides for movement over carpet. The unit 50 can occupy about 20 square feet of floor space, although it can be larger if desired.

In a preferred embodiment a foot rail 18 (as in FIGS. 1-7) is attached to the structure to enable a standing person 56 at the outside of the desk to elevate one foot onto the bar rail for comfort. The desk 58 of the unit is thus at approximate bar height (e.g. 40" to 42" or somewhat higher if desired) to the person 20 standing outside. The pod or structure 50 is preferably elevated so that the interior floor 52 is approximately 10" to 14" above the surrounding floor structure or ground, so that a person 24 sitting at the desk within the unit 50 is generally at or close to the same eye level as an average person 20 standing outside the desk or bar. The desk 58 may be, for example, about 28" to 30" above the surface of the floor 52, i.e. in the range of standard desk height, or more broadly, about 27" to 31" above the unit floor 52.

As seen in the drawings, a built-in seat 60 can be provided, preferably padded or with a cushion, supported above the floor, as by seat support structure 61. If the structure does not include a built-in seat, it has provision for a seat, i.e. a space behind the desk for a user to bring in a seat or chair. As shown, the desk or table is very roughly pentagonal in shape but with a concave fifth side 58*a* for comfort and convenience to a user sitting at the desk. The desk in this preferred configuration has a forward corner 59 which is directly in front of the user/occupant, at the deepest point of the desk from the user. The side edges, one on each side of the corner 59, extend back from the corner. A grab bar (not shown) can be provided on an inside face of the frame 62, adjacent to the entry, to help a user climb into the pod.

As seen in the drawings, the pod or enclosure structure 50 includes two frames 62 that are preferably at less than 90° to one another, e.g. about 70°. Between them is a back wall 64 that provides a backing for the interior seat 60. A seat back 66 can also be included for comfort.

As seen in the drawings, a ceiling/roof 68 is optionally included, shown as glass (or transparent or clear plastic material; "glass" herein is to be understood either way) in the drawings. The roof, important for outdoor use, preferably is supported by cantilever arms 70 secured rigidly to and extending from the frames 62, as shown. This allows omission of any column positioned at the apex of the two cantilever arms 70. The desk or table 58 is also shown as cantilevered at its outer edges 58*b*. The desk is supported on the frames 62 as shown, and also by some of a series of forward wall sections 72*a* and 72*b*, as seen particularly in FIGS. 10-12. The wall sections 72*a* are vertical, or approximately vertical and extend out from the frames 62. Completing an enclosure of the space in front of the user's legs, under the desk, are the obliquely angled front panels 72*b*. Each section 72*b* slopes back from a connection with the vertical section 72*a*, and the two oblique sections 72*b* together provide support for the desk or table 58. This means for knee room of person on outside who may choose to pull up a stool.

The drawings show a wall panel 74 which can be of any material, shown as glass, preferably a door hinged at a back edge 76 on the frame, near the user's seat (it could be hinged on the other side if need be). Such a door can be provided at both left and right of the user's seat position, in each of the frames 62, or at one side the glass panel wall section can be fixed. These panels 74 function as partial enclosure walls. For arranging multiple pods 50 in a clustered array, as discussed below, left hand and right hand pods, as referring to a single openable door, can be provided. The drawings also show a lower access door 78 in the frame 62, as a cut-out from the overall area defined by the frame, for the purpose of access to storage space 79 under the seat 60. These access doors 78 can be of any material, such as wood or metal, and preferably are provided in both frames 62 but could be provided in only the side with a single openable door 74. Also, the glass door 74 could simply be a full rectangle so that it closes the access space when closed (it could be frosted or otherwise obscured at the access space if desired). Note that the storage space could be accessed in a different way, such as though an openable section of the seat 60 or through an opening in the seat support structure 61.

Figure 8A:
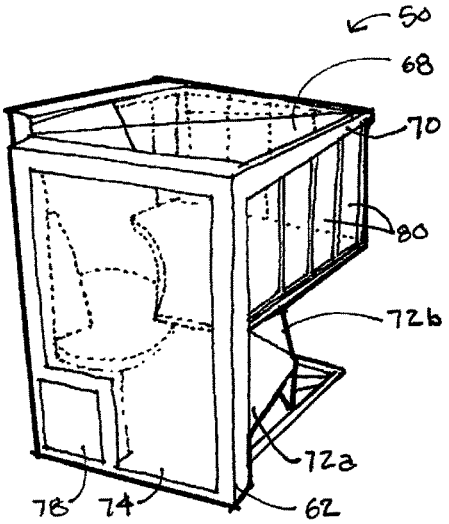
FIG. 8A is another perspective view, showing windows of the unit closed.
Figure 9:
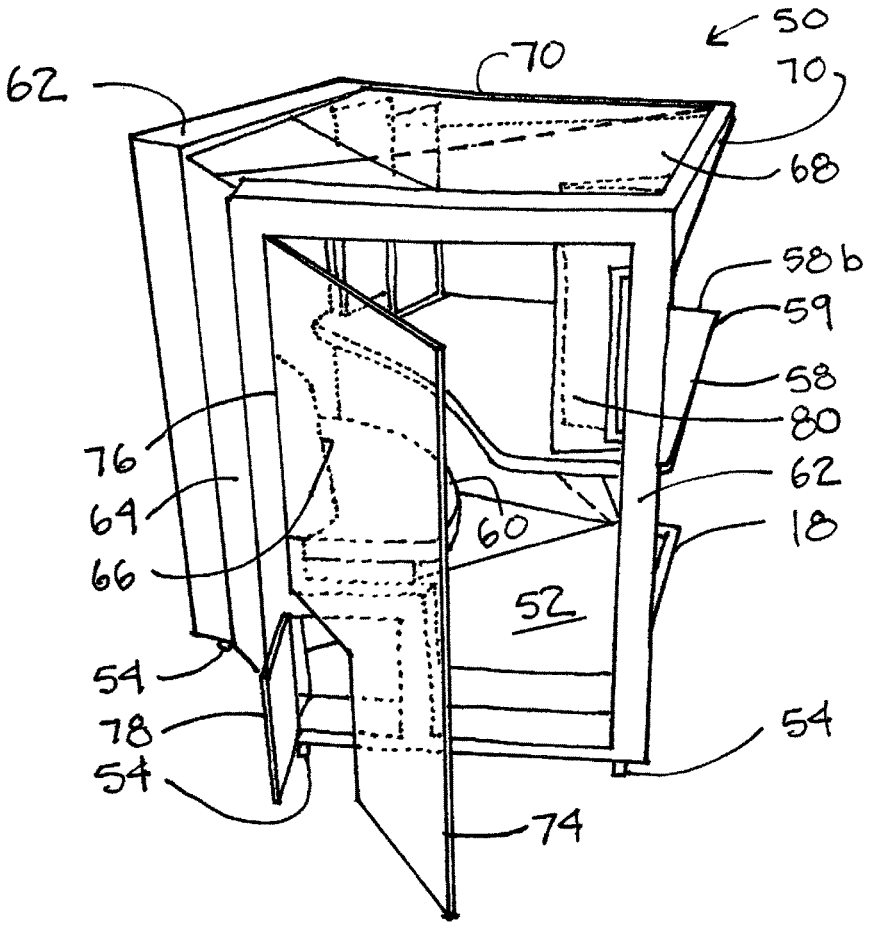
FIG. 9 is a perspective view showing the unit of FIGS. 8 and 8A.
Figure 10:
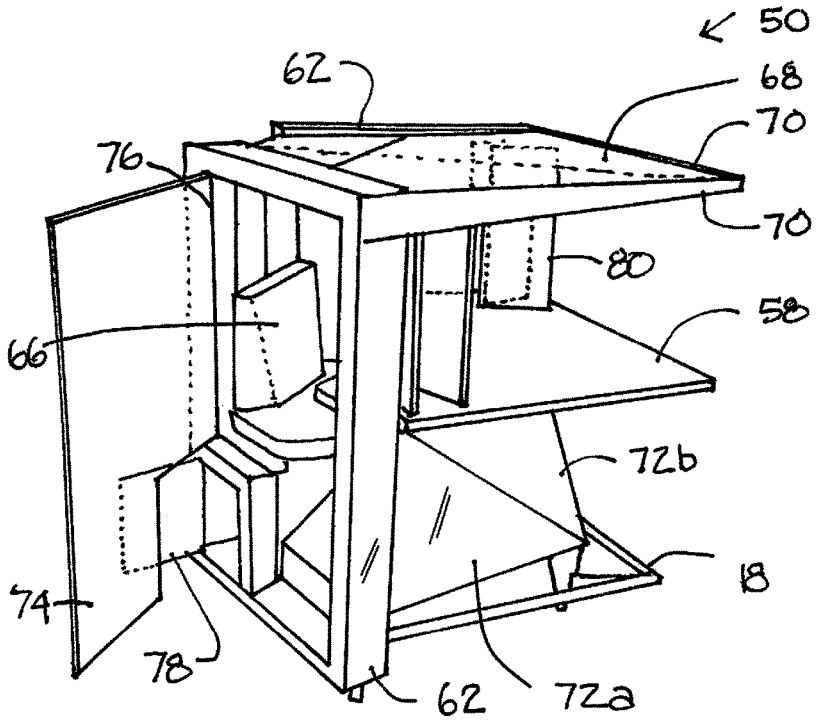
FIG. 10 is another perspective view of the structure shown in FIG. 8.

Series of hinged folding windows 80 also are provided, preferably at two sides of the pod in front of the user, for closing the space between the desk top 58 and the cantilever arm 70 at each side. FIG. 8A schematically shows the pod with the windows closed (the door 74 is shown partly open to illustrate the interior). FIG. 10, on the other hand, shows the windows opened and the desk space/bar open for passersby to interact with the person seated within the pod (note that the folding windows can be stored flatly together against the frame 62).

With the doors and windows of the enclosure or pod 50 fully closed, the unit is essentially sealed off against the exterior, limiting noise audible to the occupant. The degree of sealing can be such as required, with a greater seal employed if the unit 50 is to be used outside. If such a higher degree of seal is provided, a source of moving air can be established via one or more openings and optionally a fan, such as below or above the seat (or both), through the seat support structure 61, through the storage space 79 and through the back wall 64. One or more vents could alternatively provided in the under-desk front panels 72*a*, 72*b*. Further, a UL listed dog house heater can be provided to warm the interior. Note that when the pod is characterized herein as fully closed, this does not mean hermetically sealed or fully soundproofed. Normal small gaps will occur where window panels meet and doors close against frames.

FIG. 10 shows the unit 50 opened at front (the window panels 80 will be fully stacked together). The panoramic view out of the front corner window is what gives the person a sense of vast perspective and openness despite being in a small space that might otherwise feel claustrophobic. This is a unique feature. Also, the wall panel 64 behind the person (between frames 62) is not just structural but offers a sense of security because the person can't be viewed from behind.

The roof is sloped to drain toward the back, to prevent water from draining down the windows and doors. This is especially important so the pods won't drain onto each other if they are grouped together outdoors. The vertical surface where the water drains down is recessed in such a way that if the pods are put back to back it doesn't impede with drainage.

Figure 11:
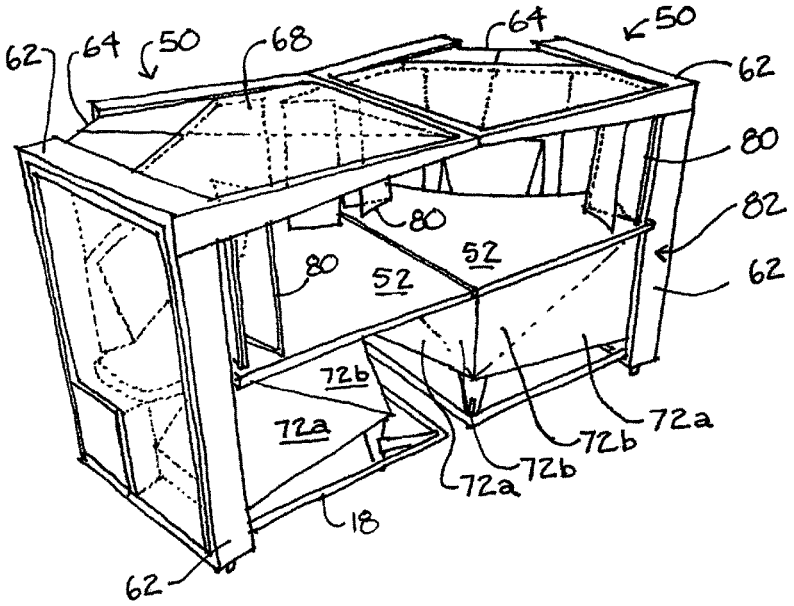
FIG. 11 is a perspective view showing two of the pods or units shown in FIG. 8 clustered side by side, for two persons.

FIG. 11 shows two of the pods 50 positioned side by side, essentially making one large common desk 52 and enabling two persons to work together, either with windows open for social interaction with others, or with the windows at the front side of the combined structure closed for working together privately. In this configuration the interior foldable windows are not needed, or one set of the windows 80 could be closed if at some point privacy is desired between the two persons in the combined space. In this embodiment of the pods 50, the two cantilever arms 70 at the top of the structure preferably form a right angle, so that when the pods are positioned side by side to form a structure as shown in FIG. 11, the front of the combined enclosure, i.e. the open side 82 shown in FIG. 11, is essentially planar. This provides the ability to add one or two further pods in a nested cluster, as further discussed below.

FIG. 11A is a schematic plan diagram showing three of the units 50 nested together, producing essentially three-quarters of a generally square pattern. FIG. 11B shows four units put together, completing an approximately square cluster and providing for four persons to work together, and at times independently, via the folding glass windows.

Figure 12:
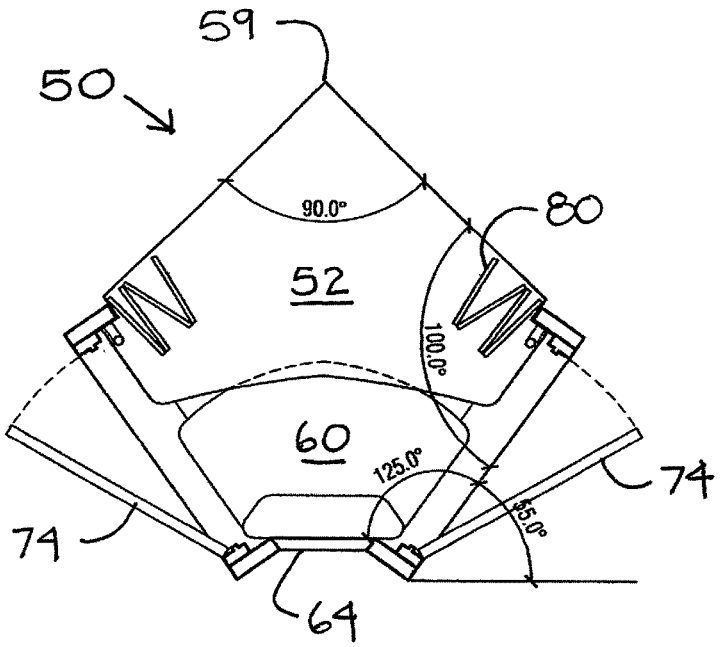
FIGS. 12 and 12A are schematic top plan views showing single desk enclosure or pod units, with desk angles of 90° and 120°, respectively.
Figure 12A:
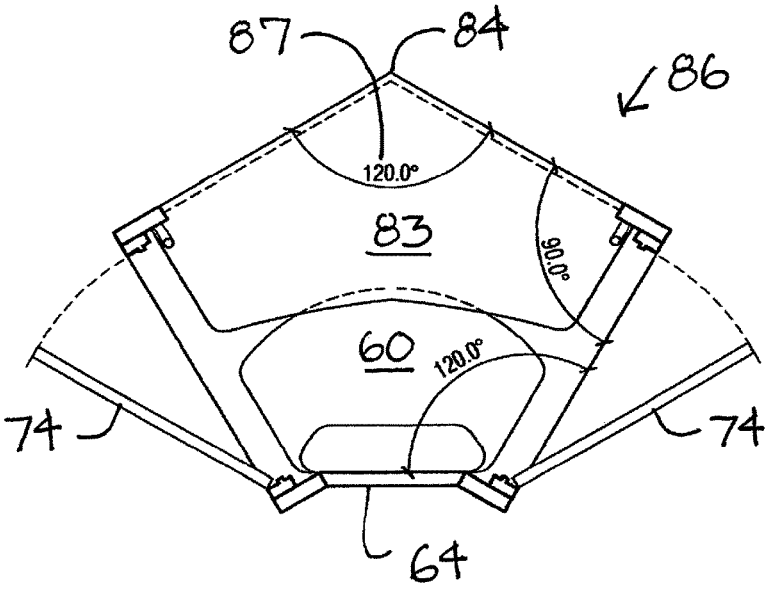

FIG. 12 schematically shows a single 90° pod unit 50 in plan view, showing the forward right angle corner 59 formed at the front of the unit in this embodiment. Also shown are the doors 74, the desk 52 and the seat 60. The roof is not shown in this view. FIG. 12A shows an alternative desk 83 with a 120°-angled desk forward corner 84, alternative to the right angle at 59 in FIG. 12. This occurs with the embodiment 86 described in FIGS. 13 and 14, configured so that two or three units can be fitted together. FIG. 12A also shows in dashed line a further alternative: either unit 86 or 50 can have a rounded (circular or elliptical) forward edge 87.

Figure 13:
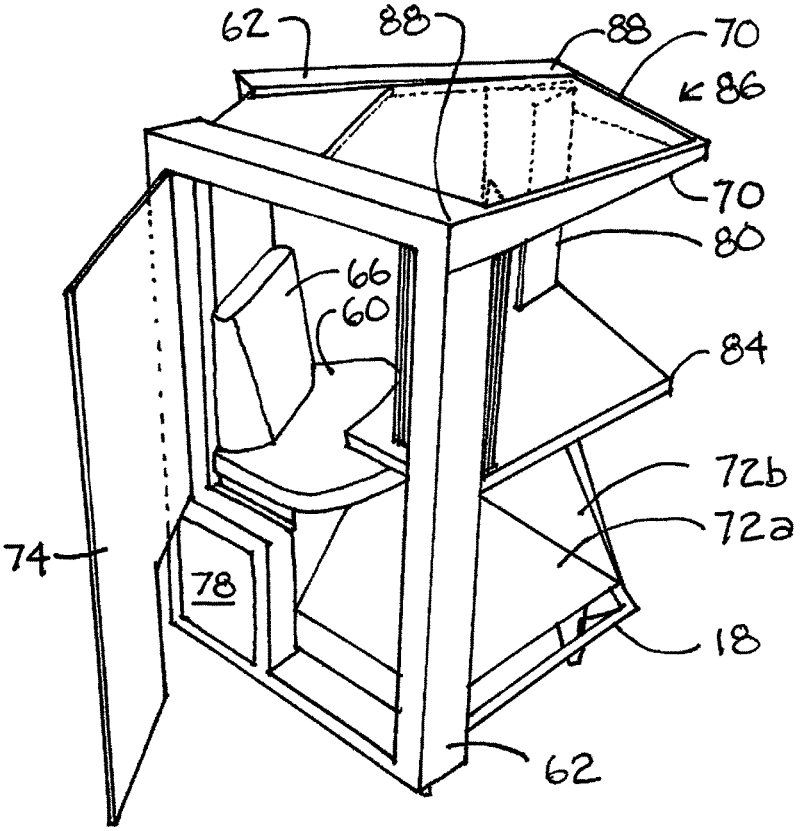
FIG. 13 is a perspective view showing a third embodiment, which is a variation of the structure shown in FIGS. 8 to 11.

FIG. 13 shows the 120° unit 86. The cantilever arms 70, as well as the desk 84 and the bottom/front enclosure panels 72*a* and the bar rails 18, conform to the 120° angle configuration. This makes the desk 84 somewhat smaller than the desk 52 of the previously described embodiment, as also illustrated in FIG. 12, but the units 50 and 86 can be scaled up or down as desired.

Figure 14:
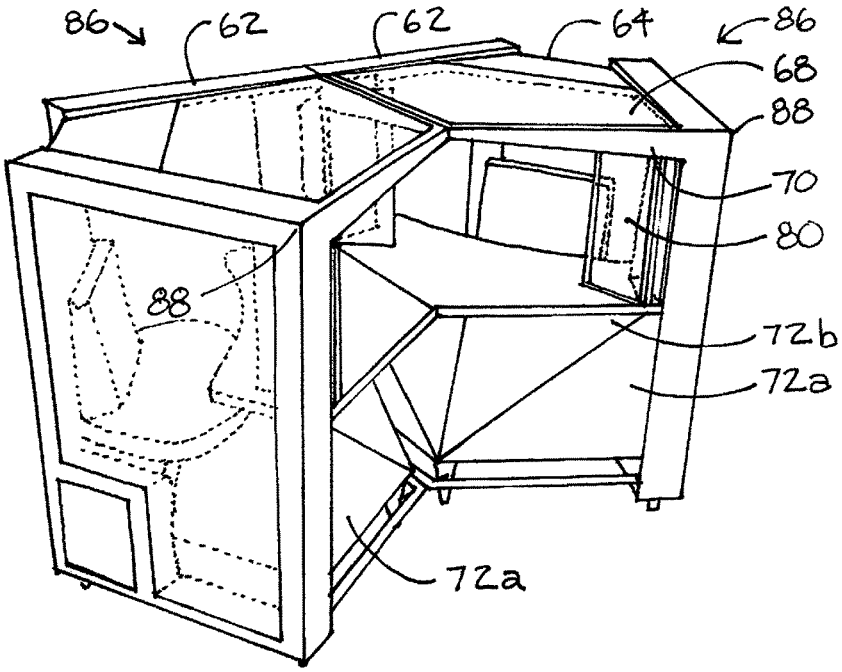
FIG. 14 is a perspective view showing two units of the type shown in FIG. 13 clustered side by side.

FIG. 14 shows a cluster of two of the 120° units 86. In these units the corners shown at 88 can be at right angles, i.e. with the cantilever 70 forming a right angle with the attached frame 62. This is not the case with the previous form of pod 50 in the illustrated embodiment, as can be seen in the diagram of FIG. 12 (although the structure could be modified to put the corners at right angles). With these corners 88 each at right angles, the frames 64 at the opposite side of the double-configuration assembly can form a plane, as seen in FIG. 14. As is also clear from FIG. 14, a third unit 86 can be placed against the 120°-angled front, to form a full enclosure for three people. Again, the only function for the folded window panels 80 would then be to grant privacy to any one of the occupants, or to all the occupants.

The clustered units could be latched together if desired, with simple frame-to-frame latches (not shown).

Although the units 86 described herein are shown with a forward desk corner in front of the occupier of the enclosure, the unit front could alternatively be round, i.e. a portion of a circle or of an ellipse, as noted above and indicated in FIG. 12A. In that case the shape of the desk would be followed by the foot rail, the enclosure panels 72*a* and 72*b*, and the cantilever arms 70 at the roof. The units then would not be clustered together in the same way, although they could be side-by-side at side panels 74 or back to back at the back walls 64. Folding windows 80 can still be provided for a closed configuration of the unit.

The enclosure units described herein, particularly the units 50 and 86, can be used in many advantageous ways. The unit could be inside a residence or other building, for private study and homework as used by a student, with a choice of the unit being partially open or fully closed. It could be used outdoors for a variety of different purposes, such as reading or telephone calls in private while still being out in nature. The units could serve many other purposes as well.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A free-standing unit to accommodate at least one seated person at a desk, partially enclosed, while allowing interaction with others standing outside the unit, comprising:

a structure forming a partial enclosure with a desk built into the enclosure and provision for a seat at the desk, and a unit floor for the feet of a person seated at the desk, partial enclosure walls at two sides of the unit affording some privacy to a seated person, at least a partial roof positioned to be over a person seated at the desk, the desk having a forward edge extending outwardly from the partial enclosure walls, defining a forward corner and two side edges, one at each side of the forward corner, so that the desk is deepest directly in front of a person seated at the desk, such that a person can stand outside the unit at one of said side edges of the desk for interaction with the seated person, with the unit being open above the desk at both left and right relative to the seated person to provide a panoramic view for the seated person, the desk being at a comfortable desk height above the unit floor, and the unit floor being elevated about 10" to 14" above a surrounding floor or other surface on which the unit rests, so as to put a person seated at the desk is close to eye level with a standing person outside the unit and facing the desk, whereby the free-standing unit promotes face-to-face interaction and conversation between a seated person at the desk and one or more standing persons outside the unit and facing the desk, with the sitting and standing persons close to eye level with one another, while providing the seated person a sense of personal and psychological security.

2. The free-standing unit of claim 1, occupying a space no greater than about five feet six inches by five feet six inches.

3. The free-standing unit of claim 1, wherein the unit occupies an area no greater than about 20 square feet.

4. The free-standing unit of claim 1, wherein the desk is at a height above the unit floor in the range of 27" to 31".

5. The free-standing unit of claim 1, wherein access for a person to be seated at the desk is via a rear opening between the partial enclosure walls.

6. The free-standing unit of claim 1, wherein said provision for a seat comprises two seats included in the structure, positioned for users to be seated behind the desk.

7. The free-standing unit of claim 1, wherein said provision for a seat is a single seat in the unit for only one person.

8. The free-standing unit of claim 7, wherein the single seat is built into the structure and includes a storage space beneath.

9. The free-standing unit of claim 8, with an access door at the exterior of the unit and at one side of the seat, leading to the storage space.

10. The free-standing unit of claim 1, wherein the partial enclosure walls comprise panels, one at each of left and right of the seat, at least one of which is hinged and opens as an access door.

11. A free-standing unit to accommodate at least one seated person at a desk, partially enclosed, while allowing interaction with others standing outside the unit, comprising:

a structure forming a partial enclosure with a desk built into the enclosure and provision for a seat at the desk, and a unit floor for the feet of a person seated at the desk, partial enclosure walls at two sides of the unit affording some privacy to a seated person, the desk having a forward edge extending outwardly from the partial enclosure walls so that the desk is deepest directly in front of a person seated at the desk, such that a person can stand outside the unit adjacent to the forward edge of the desk for interaction with the seated person, with the unit being open above the desk at both left and right relative to the seated person to provide a panoramic view for the seated person, the desk being at a comfortable desk height above the unit floor, the unit floor being elevated above a surrounding floor or other surface on which the unit rests, so as to put a person seated at the desk close to eye level with a standing person outside the unit and facing the desk, and the partial enclosure walls comprising panels, one at each of left and right of the seat, both panels being hinged to act as access doors, whereby the free-standing unit promotes face-to-face interaction and conversation between a seated person at the desk and one or more standing persons outside the unit and facing the desk, with the sitting and standing persons close to eye level with one another, while providing the seated person a sense of personal and psychological security.

12. A free-standing unit to accommodate at least one seated person at a desk, partially enclosed, while allowing interaction with others standing outside the unit, comprising:

a structure forming a partial enclosure with a desk built into the enclosure and provision for a seat at the desk, and a unit floor for the feet of a person seated at the desk, partial enclosure walls at two sides of the unit affording some privacy to a seated person, the desk having forward edge extending outwardly from the partial enclosure walls so that the desk is deepest directly in front of a person seated at the desk, such that a person can stand outside the unit adjacent to the forward edge of the desk fox interaction with the seated person, with the unit being open above the desk at both left and right relative to the seated person to provide a panoramic view for the seated person, the desk being at a comfortable desk height above the unit floor, the unit floor being elevated above a surrounding floor or other surface on which the unit rests, so as to put a person seated at the desk close to eye level with a standing person outside the unit and facing the desk, and the unit being fully closeable, with a rear wall behind the seat, a closure under the desk, said partial enclosure walls enclosing the unit at left and right of the seat, and foldable window panels at the two side edges of the desk, and including a roof fully covering the desk, whereby the free-standing unit promotes face-to-face interaction and conversation between a seated person at the desk and one or more standing persons outside the unit and facing the desk, with the sitting and standing persons close to eye level with one another, while providing the seated person a sense of personal and psychological security.

13. A free-standing unit to accommodate at least one seated person at a desk, partially enclosed, while allowing interaction with others standing outside the unit, comprising:

a structure forming a partial enclosure with a desk built into the enclosure and provision for a seat at the desk, and a unit floor for the feet of a person seated at the desk, partial enclosure walls at two sides of the unit affording some privacy to a seated person, the desk having a forward edge extending outwardly from the partial enclosure walls so that the desk is deepest directly in front of a person seated at the desk, such that a person can stand outside the unit adjacent to the forward edge of the desk for interaction with the seated person, with the unit being open above the desk at both left and right relative to the seated person to provide a panoramic view for the seated person, the desk being at a comfortable desk height above the unit floor, the unit floor being elevated above a surrounding floor or other surface on which the unit rests, so as to put a person seated at the desk close to eye level with a standing person outside the unit and facing the desk, and wherein the structure includes generally rectangular frames at rear left and right of the seat, to which said partial enclosure walls are attached, a rear wall behind the seat and secured to the two frames, one at either side of the rear wall, and cantilever arms at a top of the structure, one extending from each of the frames, toward one another to a connection of remote ends of the cantilever arms at a forward apex at the top of the unit, to support a roof over the desk, the desk being supported by the frames and by desk support structure under the desk and connected to the floor.

14. The free-standing unit of claim 1, with two said free-standing units clustered together along one edge of the desk of each unit, forming a larger desk surface to accommodate two persons.

15. The free-standing unit of claim 1, including three said units clustered together along desk edges so as to form a partial enclosure with a large desk surface to accommodate three persons, with a limited opening to standing persons at the outside of the desk.

16. The free-standing unit of claim 1, wherein the forward corner of the desk makes an angle of substantially 90°, and with four said units clustered together with desk edges abutted, forming an enclosure with a large desk surface to accommodate four persons, for persons seated at the desks without interaction from anyone outside.

17. The free-standing unit of claim 1, wherein the forward corner of the desk makes an angle of substantially 120° so that the two such units or three such units can be clustered together with desk edges abutted.

* * * * *